US006877670B2

(12) United States Patent
Underhill

(10) Patent No.: US 6,877,670 B2
(45) Date of Patent: Apr. 12, 2005

(54) BOILER VENTILATION SYSTEM

(75) Inventor: Robert John Underhill, Edmonton (CA)

(73) Assignee: ALSTOM Technology Ltd, Baden (CH)

( * ) Notice: Subject to any disclaimer, the term of this patent is extended or adjusted under 35 U.S.C. 154(b) by 17 days.

(21) Appl. No.: 10/413,947

(22) Filed: Apr. 15, 2003

(65) Prior Publication Data

US 2004/0206831 A1 Oct. 21, 2004

(51) Int. Cl.[7] ..... F24H 3/08
(52) U.S. Cl. ..... 237/19; 237/46; 237/7
(58) Field of Search ..... 237/46, 7, 19, 237/16

(56) References Cited

U.S. PATENT DOCUMENTS 1,657,771 A * 1/1928 Summers ..... 122/20 B
3,198,190 A * 8/1965 Gordon ..... 126/101
4,134,448 A * 1/1979 Luksus ..... 165/62
4,241,874 A * 12/1980 Schossow ..... 237/55
4,311,191 A * 1/1982 VanderVaart ..... 165/240
4,412,652 A * 11/1983 Voss et al. ..... 237/16
4,798,240 A * 1/1989 Gerstmann et al. ..... 165/48.1
5,112,215 A * 5/1992 Frish et al. ..... 431/3

* cited by examiner

*Primary Examiner*—Derek S. Boles
(74) *Attorney, Agent, or Firm*—Arthur E. Fournier, Jr.

(57) ABSTRACT

A method of ventilating a boiler system (10) during boiler system outages includes shifting (64) to the ventilation system (11) by stopping (70) the boiler system induced draft fan (32), closing (71) an internal isolation damper (19) in the boiler system ductwork (14), opening (72) a ventilation isolation damper (18), and starting (73) a ventilation fan (12). At the completion of the outage, before resuming operation of the boiler, the ventilation system (11) is secured (64) by stopping (80) the ventilation fan (12), closing (81) the ventilation isolation damper (18), opening (82) the internal isolation damper (19), and starting (83) the induced draft fan (32).

11 Claims, 5 Drawing Sheets

BOILER VENTILATION SYSTEM

BACKGROUND OF THE INVENTION

It is customary for maintenance and inspection workers to enter the interior of industrial boilers and areas associated with these spaces to perform necessary maintenance, inspection and repairs during boiler outages.

Inspection and maintenance workers may examine boiler structure, tubing, and associated components for wear, damage or other deviations from design specifications. In general all the components are required to be observed by maintenance or inspection workers who would not otherwise be able to do so during boiler operation. Repair and maintenance may involve numerous operations such as welding, chemical treatments, and physical cleaning such as scraping, grinding and/or sandblasting. Chemical agents and cleaners may be highly toxic, and/or produce harmful or toxic fumes or vapors when used.

Welding often produces products of combustion which may be a mixture of very fine particles and gases. The fumes and gases produced during welding may arise from such things as the base materials themselves, material coatings, shielding gases, filler materials, compounds produced from environmental constituents by the heat and light mediated reactions arising from the electrical arc or high temperature flame used to weld. Many of the substances may be extremely toxic. Such things as oxides of nitrogen and ozone are gases of major toxicological importance, and incomplete oxidation may occur and carbon monoxide can form as a byproduct. In addition shielding gases such as argon may settle and displace life-supporting atmosphere.

In general, any process that produces dust particles fine enough to remain in the air long enough to be inhaled, ingested or absorbed may be regarded as hazardous. The confined spaces of the boiler and associated areas may magnify the exposure profile to airborne particles due to insufficient ventilation.

Particulate matter that builds up on the interior surfaces of the boiler during operation may become dislodged or become dispersed in the air when scraping, grinding, sandblasting or any of the numerous cleaning methods are employed. These materials may present both a long term and short term risk to the health and safety of maintenance and boiler inspection workers. It is particularly well known that abrasive blasting and other techniques such as scouring and polishing where silica flows may be used may cause rapidly progressive disease. Sandblasting creates airborne particulates generally of a silicate nature, which when breathed in are injurious to maintenance and inspection workers. Depending on the substance, such things as lung disease can occur due to accumulation of particles within the lungs or by interaction of the foreign particles with the body.

Generally, ventilation is required to keep unwanted elements at a safe level. Unwanted elements may be any or combinations of materials in various physical states, and may include gases, vapors, liquids, mists, dust, flakes, and particulates. Additionally, inadequate ventilation may allow for a deterioration of air quality wherein for example oxygen, carbon dioxide, carbon monoxide, and other substance levels may be increased or decreased to present physical uncomfort and other hazards to maintenance or inspection workers.

There are numerous laws, regulations and procedures in place with regard to air quality for workers. Boilers are often considered to be confined spaces, requiring a means to ensure that an oxygen concentration within the space is generally between 19.5% and 21.5%.

In the past, maintenance of air quality for workers within the boiler during outages has been approached by placing a fan within the opening of an access panel. This practice suffers from numerous drawbacks such as inadequate size of the opening of the access panel to incorporate a sufficient sized fan in regard to ventilation requirements, and blockage of the access panel. In addition, the requirement that workers pass through the access panel often required a setup for positioning of the fan that increased the risk for maintenance and inspection workers.

Furthermore, where boiler systems are housed within buildings or structures due to, among other things, environmental considerations, the conventional manner of providing ventilation to boiler systems may create unhealthy, unpleasant, and/or unsafe conditions within the building or housing.

Another practice has been to use the induced draft fan generally present in the system for boiler operation to cool down the boiler system. However, this type of fan must be taken out of service while workers are in the interior of the boiler system. In addition using this fan during or after cleaning with water may result in damage to air pollution control equipment.

SUMMARY OF THE INVENTION

The present invention is generally directed toward providing ventilation within a boiler system through use of a fan and ductwork to maximize the air quality for maintenance and inspection workers.

Briefly stated, the invention in a preferred embodiment comprises selecting a takeoff point in a boiler system. After selecting a takeoff point in the boiler system, a ventilation fan may be selected. Selection of the ventilation fan may be based on such things as fan component configurations, ductwork configuration, and the ability of the fan to move a certain volume of air over a selected period of time. The fan may then, for instance, be positioned within an opening formed in the ductwork at the takeoff point.

An object of the invention is to provide ventilation meeting such requirements as occupational safety laws, regulations and rules in regard to ventilation of a boiler system for maintenance and inspection workers.

An object of the invention is to provide an air pathway through the boiler system by providing dampers for the purpose of isolating the ventilation fan from the boiler system when the boiler is in operation, and for isolating the backside boiler system when the ventilation system is operating.

An object of the invention is to provide adequate ventilation by opening a damper and running a fan to generate air movement through a boiler system to discharge air from the boiler system.

BRIEF DESCRIPTION OF THE DRAWINGS

Other objects and advantageous of the invention will be better understood to one of ordinary skill in the art from the following description made with reference to accompanying drawing in which.

DETAILED DESCRIPTION OF A PREFERRED EMBODIMENT

Figure 1:
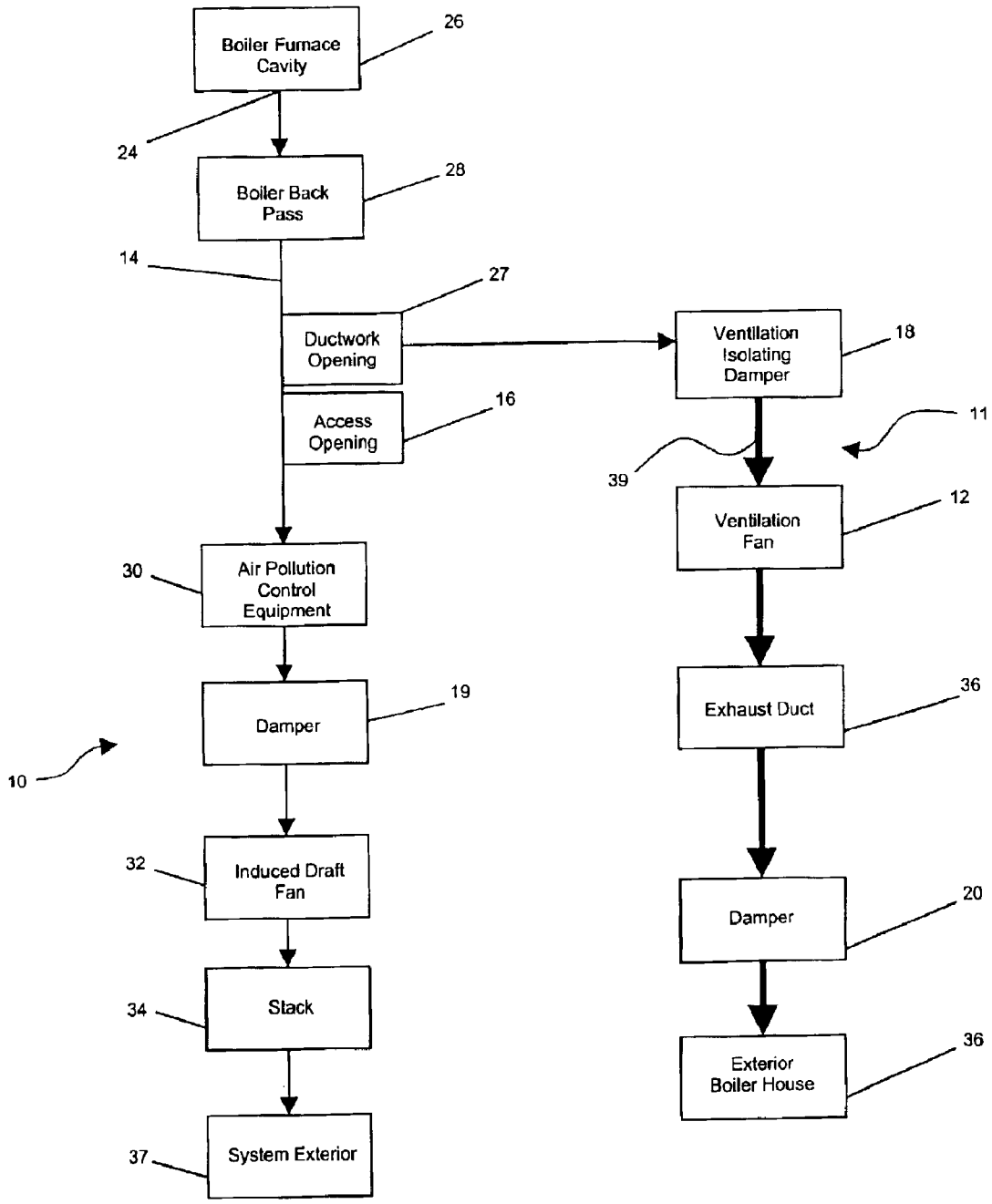
FIG. 1 is a schematic view of a boiler ventilation system in accordance with the invention.

Referring now to FIG. 1, a boiler ventilation system 11 in accordance with the invention supplies fresh air and removes unwanted elements such as heat, dust, particulate material, asphyxiating or toxic gases, and fumes from the interior of the boiler system 10 and associated boiler spaces into which maintenance or inspection workers may enter. The boiler system encompasses a boiler, ductwork 14 providing for example a passageway for combustion elements produced in the boiler furnace cavity, installed economizers and preheaters, and all spaces, manifolds, and openings in direct or indirect communication with the boiler, or which may be made in communication with the boiler.

Air intake (generally comprising the existing boiler doors) and air outlet arrangements are provided or utilized to introduce fresh air from the exterior of the boiler, and remove the unwanted elements from the interior of the boiler system. The air intake and outlet arrangements may include single or multiple openings 27. One or more fans 12 may be used to create air movement for introduction or replacement of air in a boiler system and to remove unwanted elements from the system. The fan 12 is positioned at or near for example the intake and/or outlet arrangements.

The delivery of fresh air and the removal of unwanted elements may be modified with the use of a damper 18. The damper may be any of the well known and numerous devices that allow the flow of air to be controlled. Such devices are well known in the art and may include gates, louvers, flaps, slits, holes and combinations of such features, and may further include actuating components to change such things as the positional relationships of the features. In a preferred embodiment an internal damper 19 prevents air from being drawn in from the stack 34 and allows for an air pathway to be established through the boiler cavity 26 out through the exhaust portion 36 of the ductwork 39. The internal damper 19 is a gas tight damper located near to and/or as close to the boiler opening 27 as possible. Near to or as close to the boiler opening 27 as possible may be a distance of less than about 24 inches from the boiler. The air pathway is isolated from such things as air pollution control equipment 30, which may be sensitive to the effects of moisture as well as the induced draft fan 32 and exhaust stack 34 leading out to the exterior 37 of the system.

Figure 2:
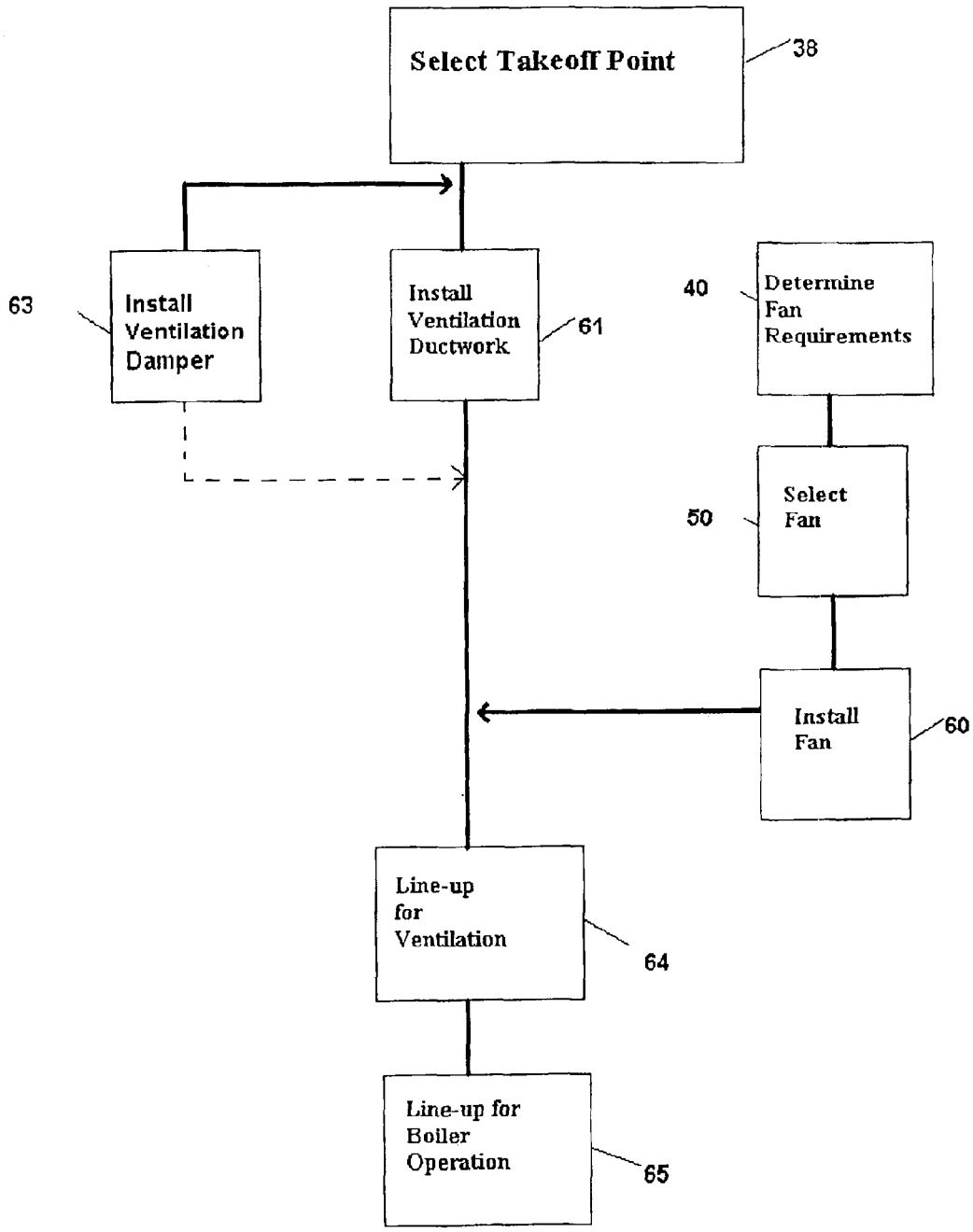
FIG. 2 is a flow diagram of a method of installing a boiler ventilation system in accordance with the invention.

With reference to FIG. 2, the design of the boiler ventilation system 11 begins with determining 40 the fan requirements. The number and/or size of the fans 12 are determined 40 based on a number of factors, which relate to the air flow characteristics of the boiler system. For example, the boiler furnace cavity 26 configuration and volume must be determined 42. However, the volume and configuration of the boiler ductwork and the boiler ventilation system ductwork volume and configuration has the largest impact on fan selection.

Figure 4:
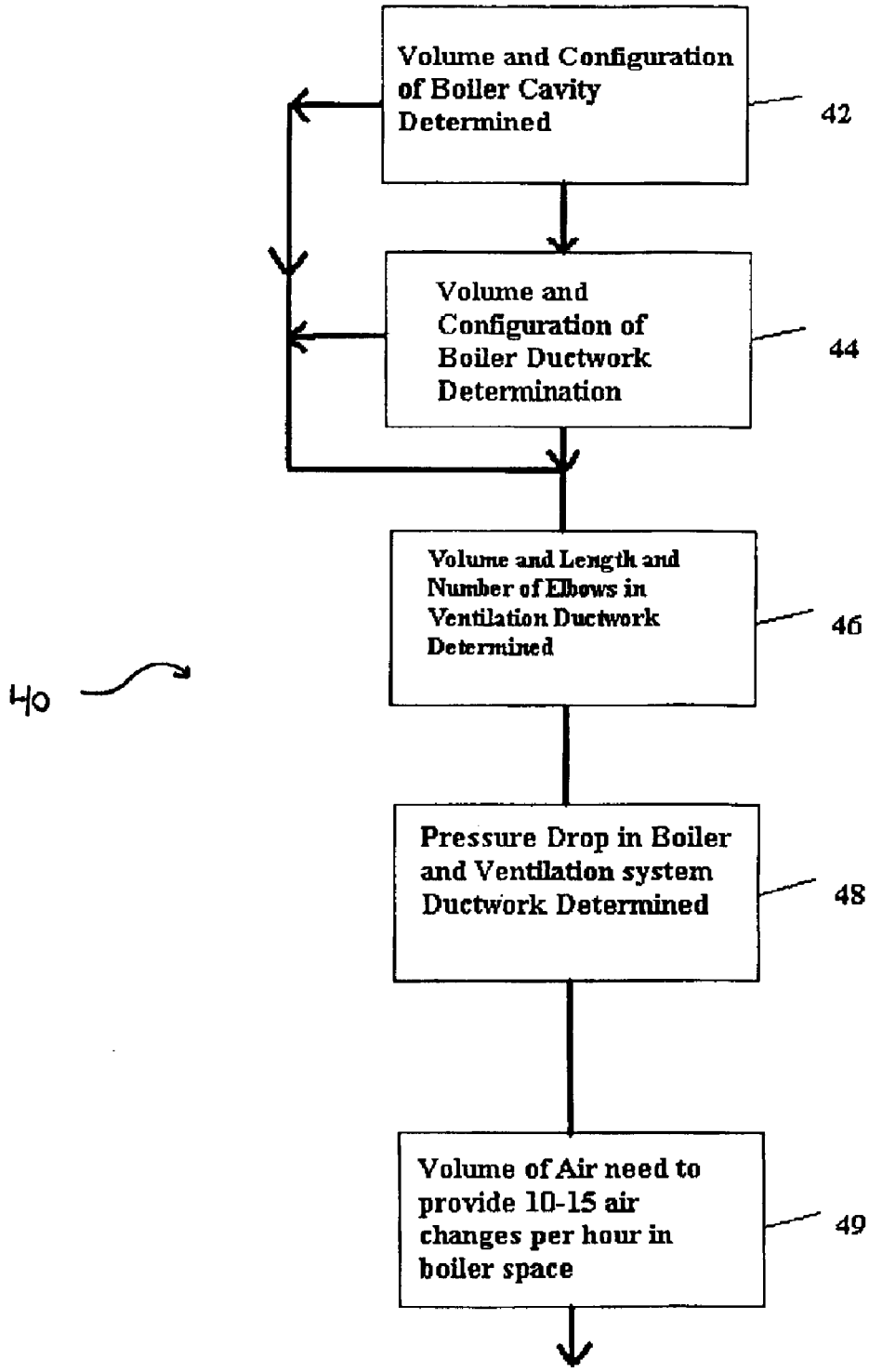
FIG. 4 is flow diagram of the step of determining fan requirements of FIG. 2.

In reference to FIG. 4, the volume and configuration of the boiler ductwork is determined 44 through measurement of the ducts and counting the number of elbows present in the boiler system. Similarly, the length, volume and number of elbows present in the boiler ventilation system ductwork are determined 46. The pressure drop in the boiler system ductwork and the boiler system ventilation system ductwork is then calculated 48, and the volume of air per unit of time needed to provide about 10 to about 15 air changes within the boiler per hour is determined 49 (where each air change is defined as a total replacement of the air volume of the boiler system). A fan may then be selected 50 based on the calculated value. Preferably, the selected fan is an induced draft fan designed for water droplet impact so that the ventilation system may be used in conjunction with a water wash system.

Figure 3:
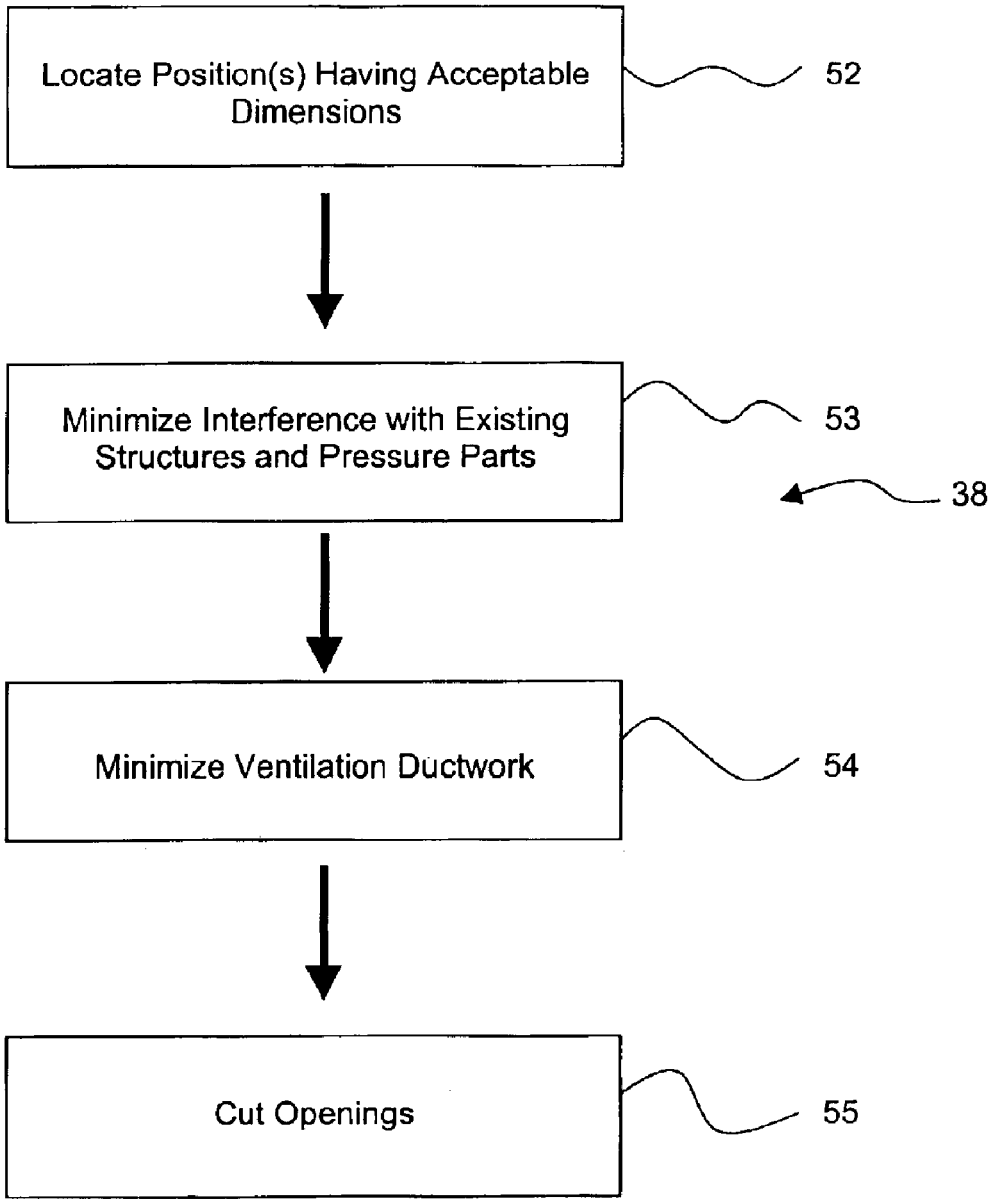
FIG. 3 is a flow diagram of the step of selecting a takeoff point of FIG. 2.

Next, the takeoff point(s) in the boiler ductwork 14 are selected 38, with the number of takeoff points being determined by the fan requirements. With further reference to FIG. 3, selection process 38 includes identifying 52 all areas of the boiler ductwork 14 having dimensions that will accommodate installation of the ventilation ductwork 39. Within this constellation of all possible installation locations, the locations, which will minimize interference between the structures of the boiler system 10 and the ventilation system 11, are identified 53. Within this sub-set of installation locations, the location that requires the minimum amount of ductwork 39 for the ventilation system 11 is identified 54. It is preferable to limit the length of the ventilation system ductwork 39 to less than 100 feet. Opening 27 is cut 55 at the location thus selected. Generally, opening 27 is located in the ductwork 14 in the boiler back pass 28, generally between the economizer of the boiler system and the generator of the boiler system. The takeoff location may also be between the economizer and an air preheater of a boiler system in a coal-fired application. To reduce the amount of work which must be conducted during the outage, the isolating damper 62 is generally installed 61 during an initial plant outage, allowing the ventilation ductwork 36 to be installed during the following period of plant operation, with the ventilation system 11 being available in the subsequent plant outage. However, the ventilation ductwork may then be installed 61 prior to the installation of the isolating damper 62. The fan 12 is installed contemporaneously with the installation 61 of the exhaust duct 36.

For boiler systems located in areas having seasonal or generally cold temperatures, the system 10 may include an outlet damper 20 to prevent cold ambient air from being drawn into the building, from the exterior the boiler house 36, during boiler operation. The installation 63 of the ventilation damper 20 is done after permanent installation 60 of the fan 12.

Figure 5A:
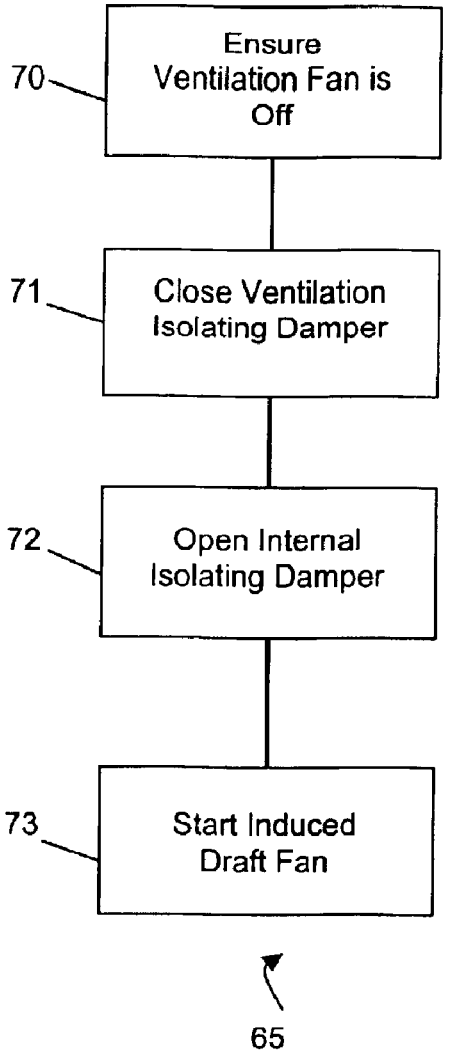
FIG. 5A is a flow diagram of the steps for shifting to boiler operation line-up.
Figure 5B:
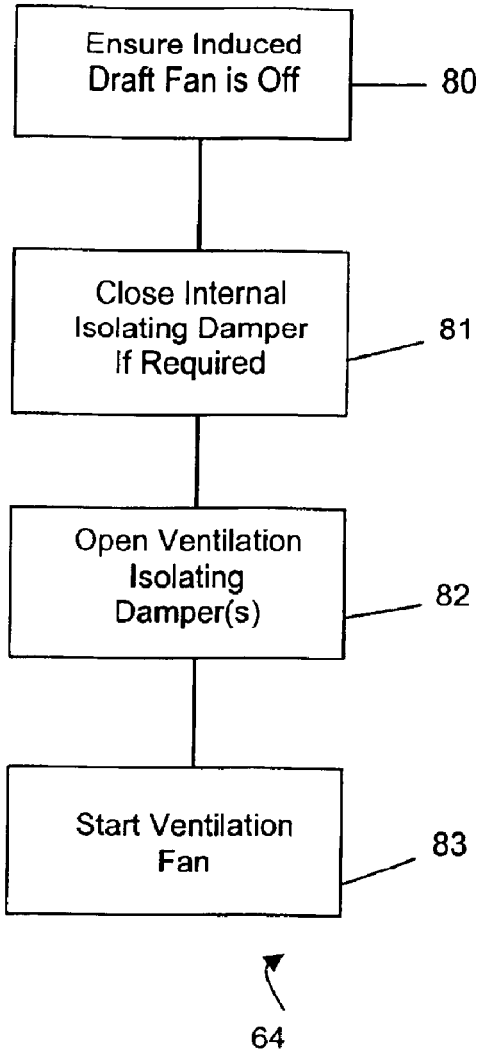
FIG. 5B is a flow diagram of the steps for shifting to ventilation line-up.

In reference to FIGS. 5A and 5B, the boiler ventilation system 11 is employed by switching 64 from the boiler operation line-up to the ventilation line-up. When switching 65 to the boiler operation line-up, it is verified 70 that the ventilation fan 12 is not running, the ventilation isolating damper 18 is closed 71, the internal isolating damper 19 is opened 72, and the induced draft fan 32 is started 73. In the case where ventilation damper 20 is present in the system it may be closed during operation of the boiler. When switching 64 to the ventilation line-up the induced draft fan 32 is verified to be off 80, the internal isolation damper 19 is closed 81, the ventilation isolating damper 18 is opened 82 to provide atmospheric communication between the ventilation ductwork and the boiler space, and the ventilation fan 12 is started 83. At the completion of the outage, before commencing boiler operations, the boiler system 10 and ventilation system 11 are switched 65 to the boiler operation line-up.

Following boiler operation, the ventilation line-up may be utilized to not only draw fresh air into the boiler space but also may be used to modify the temperature of the boiler and associated areas. In this case it may be possible to have the ventilation isolating damper 18, the internal isolating damper 19, and if present damper 20 open. At the same time both the induced draft fan 32 and ventilation fan 12 are on.

The boiler ventilation system may additionally prevent unwanted elements ventilated from the boiler system from being ejected into the boiler house, through the use of ductwork leading from the fan exhaust to a location exterior of the boiler house.

While the preferred embodiment of the foregoing invention has been set forth for the purpose of illustration, the foregoing description should not be deemed a limitation of the invention herein. Accordingly, various modifications, adaptations and alternatives may occur to one skilled in the art without departing from the spirit and scope of the present invention.

What is claimed is:

1. A method of installing a boiler ventilation system in a boiler system having a boiler, an economizer, a flue gas exhaust system, and an induced draft fan, the method comprising:

determining ventilation fan requirements for the boiler system;

selecting a takeoff point in the ductwork of the boiler system that includes boiler system ductwork for exhausting flue gas and an internal isolation damper disposed in the boiler system ductwork;

permanently installing a ventilation system ductwork at the takeoff point, the ventilation system ductwork being connected to the flue gas exhaust system intermediate the economizer and the internal isolation damper;

installing a ventilation isolation damper in the ventilation system ductwork; and installing a ventilation fan in the ventilation system ductwork, wherein the flue gas exhaust system is utilized during boiler system operations by (a) ensuring the ventilation fan is off, (b) ensuring the ventilation isolation damper is closed, (c) ensuring the internal isolation damper is open, and (d) running the induced draft fan, the ventilation system is utilized during boiler system outages by (a) stopping the induced draft fan, (b) closing the internal isolation damper, (c) opening the ventilation isolation damper, and (d) starting the ventilation fan, and a transition from the utilization of the ventilation system to the flue gas exhaust system at the completion of a boiler system outage before resuming operation of the boiler includes (a) stopping the ventilation fan, (b) closing the ventilation isolation damper, (c) opening the internal damper, and (d) starting the induced draft fan.

2. The method of claim 1, wherein the step of selecting a takeoff point includes identifying all areas of the boiler system downstream of the boiler economizer that have dimensions that can accommodate installation of the ventilation system ductwork.

3. The method of claim 2, wherein the step of selecting a takeoff point further includes identifying those areas having the proper dimensions which minimize interference between the ventilation ductwork and boiler structures.

4. The method of claim 3, wherein the step of selecting a takeoff point further includes identifying those areas having proper dimensions and which minimize interference which do not occlude an access port.

5. The method of claim 1, wherein the step of selecting a takeoff point further includes minimizing the length of ventilation ductwork.

6. The method of claim 1, wherein the step of determining fan requirements includes selecting a ventilation fan by:

determining the volume and configuration of the boiler furnace cavity;

determining the volume and configuration of the boiler system ductwork;

determining the volume and configuration of the boiler ventilation system ductwork;

calculating a pressure drop in the boiler furnace cavity, boiler system ductwork, boiler ventilation system ductwork;

determining the volume of air per unit of time needed to provide between about 10 and about 15 air changes per hour in the boiler; and selecting a fan based on the determinations and calculations.

7. The method of claim 6 wherein the step of determining fan requirements further includes selecting a fan that is designed for water droplet impact.

8. The method of claim 1 wherein the step of installing the ventilation isolation damper includes installing the ventilation isolation damper at a distance of no more than 24 inches away from a boiler opening.

9. The method of claim 1 further comprising installing a damper in the boiler system ductwork downstream of the takeoff point.

10. A method of operating a boiler system having an induced draft fan, a boiler, a flue gas exhaust system, and a ventilation system, the boiler having an economizer, the flue gas exhaust system including boiler system ductwork and an internal isolation damper disposed in the boiler system ductwork, the ventilation system including ventilation system ductwork connected to the flue gas exhaust system intermediate the economizer and the internal isolation damper, a ventilation fan disposed in the ventilation system ductwork, and a ventilation isolation damper disposed in the ventilation system ductwork intermediate the boiler system and the ventilation isolation damper, the method comprising the steps of:

utilizing the flue gas exhaust system during boiler system operations by:
ensuring the ventilation fan is off,
ensuring the ventilation isolation damper is closed,
ensuring the internal isolation damper is open and running the induced draft fan;

shifting to the ventilation system during boiler system outages by:
stopping the induced draft fan,
closing the internal isolation damper,
opening the ventilation isolation damper, and
starting the ventilation fan; and shifting to the flue gas exhaust system at the completion of the outage before resuming operation of the boiler by:
stopping the ventilation fan,
closing the ventilation isolation damper,
opening the internal isolation damper, and
starting the induced draft fan.

11. A boiler ventilation system for a boiler, the boiler having an economizer, comprising:

an induced draft fan;

a flue gas exhaust system, the flue gas exhaust system including boiler system ductwork and an internal isolation damper disposed in the boiler system ductwork; and a ventilation system including ventilation system ductwork connected to the flue gas exhaust system intermediate the economizer and the internal isolation damper, a ventilation fan disposed in the ventilation system ductwork, and a ventilation isolation damper disposed in the ventilation system ductwork, wherein the flue gas exhaust system is utilized during boiler system operations by (a) ensuring the ventilation fan is off, (b) ensuring the ventilation isolation damper is closed, (c) ensuring the internal isolation damper is open, and (d) running the induced draft fan, the ventilation system is utilized during boiler system outages by (a) stopping the induced draft fan, (b) closing the internal isolation damper, (c) opening the ventilation isolation damper, and (d) starting the ventilation fan, and a transition from the utilization of the ventilation system to the flue gas exhaust system at the completion of a boiler system outage before resuming operation of the boiler includes (a) stopping the ventilation fan, (b) closing the ventilation isolation damper, (c) opening the internal isolation damper, and (d) starting the induced draft fan.

* * * * *